US006172689B1

(12) United States Patent
Cunnagin et al.

(10) Patent No.: US 6,172,689 B1
(45) **Date of Patent: *Jan. 9, 2001**

(54) APPARATUS AND METHOD FOR VARYING PRINT ELEMENT SPACING IN A PRINTING SYSTEM

(75) Inventors: Stephen Kelly Cunnagin; Scott Michael Heydinger, both of Lexington, KY (US)

(73) Assignee: Lexmark International, Inc., Lexington, KY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 08/965,989

(22) Filed: Nov. 7, 1997

Related U.S. Application Data

(63) Continuation-in-part of application No. 08/806,172, filed on Feb. 26, 1997, now Pat. No. 5,923,348.

(51) Int. Cl.[7] ..... B41J 25/308; B41J 29/38; B41J 2/155; B41J 11/20

(52) U.S. Cl. ..... 347/8; 347/14; 347/42; 400/55

(58) Field of Search ..... 347/40, 43, 15, 347/14, 8, 42; 400/55

(56) References Cited

U.S. PATENT DOCUMENTS

| | | | | |
|---|---|---|---|---|
| 4,344,079 | | 8/1982 | Chambors et al. | 346/140 R |
| 4,395,720 | | 7/1983 | Grover et al. | 346/140 R |
| 4,528,575 | | 7/1985 | Matsuda et al. | 346/140 R |
| 4,612,554 | | 9/1986 | Poleshuk | 345/140 R |
| 4,622,560 | | 11/1986 | Withoos et al. | 346/1.1 |
| 4,675,696 | * | 6/1987 | Suzuki | 347/43 |
| 4,774,529 | * | 9/1988 | Paranjpe et al. | 347/43 |
| 4,922,271 | | 5/1990 | Nilsson et al. | 346/140 R |
| 4,940,996 | | 7/1990 | Paton et al. | 346/140 R |
| 4,965,593 | | 10/1990 | Hickman | 346/140 R |
| 4,972,270 | | 11/1990 | Kurtin et al. | 358/296 |
| 5,109,239 | | 4/1992 | Cobbs et al. | 346/140 R |
| 5,142,296 | | 8/1992 | Lopez et al. | 346/1.1 |
| 5,322,594 | | 6/1994 | Bol | 156/634 |
| 5,365,645 | | 11/1994 | Walker et al. | 29/25.35 |
| 5,469,199 | | 11/1995 | Allen et al. | 347/42 |
| 5,568,169 | * | 10/1996 | Dudek et al. | 347/43 |
| 5,598,192 | * | 1/1997 | Burger et al. | 347/43 |
| 5,771,050 | * | 6/1998 | Gielen | 347/19 |
| 5,861,900 | * | 1/1999 | Lu et al. | 347/43 |
| 5,923,348 | * | 7/1999 | Cunnagin et al. | 347/42 |

* cited by examiner

*Primary Examiner*—Thinh Nguyen
(74) *Attorney, Agent, or Firm*—Taylor & Aust, P.C.; D. Brent Lambert

(57) ABSTRACT

Apparatus and method controls and varies a spacing between multiple print elements, such as ink jet print orifices, in a printing system. A signal representing at least one of an advance speed of a print medium in a feed direction in the printing system and an approximate drying time of an ink after being applied to the print medium is supplied to a controller. A device, responsive to the controller, varies the spacing between at least two print elements on the basis of at least one of the advance speed of the print medium and the approximate drying time of the ink.

25 Claims, 3 Drawing Sheets

APPARATUS AND METHOD FOR VARYING PRINT ELEMENT SPACING IN A PRINTING SYSTEM

This is a continuation-in-part of U.S. patent application Ser. No. 08/806,172 filed Feb. 26, 1997 now U.S. Pat. No. 5,923,348.

BACKGROUND OF THE INVENTION

1. Field of the Invention

The present invention relates to printers, and, more particularly, to apparatus and method for varying a spacing between at least two printing elements, such as ink jet nozzles, in a printing system.

2. Description of the Related Art

An ink jet printer typically includes a printhead having an array of ink emitting orifices, or nozzles, formed therein. The printhead is mounted on a carriage assembly which scans a width of the print medium. During a scan of the carriage assembly, ink is jetted from selected ones of the ink emitting orifices to produce a desired print image on the print medium.

It is also known to provide an ink jet printer with a printhead which extends substantially across the width of the print medium. For an ink jet printer with a 300 dot per inch (dpi) resolution, a single row of ink emitting orifices in such a printhead would include at least 2400 ink emitting orifices (i.e., 300 orifices/inch * 8 inches/page width=2400 orifices/page width).

With a page wide printhead as described above, a print quality problem may arise with respect to the associated physical geometry of the printhead due to the spatial locality of the ink emitting orifices. Because the orifices are located in a substantially linear array extending across the width of the print medium, ink dots from adjacent orifices which are to be placed within a given raster are placed on the print medium at approximately the same time. If the printhead includes multiple rows of orifices extending across the width of the page, adjacent ink dots in a given row and adjacent ink dots between rows are placed on the print medium in close proximity to each other with respect to time. For various print media, particularly transparencies, poor print quality results when ink dots are placed at adjacent positions on the print medium at approximately the same time.

SUMMARY OF THE INVENTION

The present invention is related to apparatus and method for varying a spacing between multiple print elements in a printing system. In preferred embodiments, a controller receives a signal representing at least one of an advance speed of a print medium in a feed direction in the printing system and an approximate drying time of an ink after being applied to the print medium. A device, responsive to the controller, then varies the spacing between the multiple print elements on the basis of the at least one of the advance speed of the print medium and the approximate drying time of the ink. Such print elements can be, for example, ink jet print nozzles.

In one embodiment, a first nozzle is associated with a first printhead and a second nozzle is associated with a second printhead. The device for varying the spacing includes a drive mechanism coupled to one of the first printhead and the second printhead, and an electromechanical device coupled to the drive mechanism, which when actuated by the controller, effects a change in spacing between the first printhead and the second printhead.

In another embodiment, a piezoelectric material is positioned between at least two components comprising a drive train, such that when the piezoelectric material is electrically energized, a mechanical variation in the spacing between the two components is effected.

An advantage of the present invention is that the spacing between at least two ink emitting orifices, or nozzles, or between at least two rows of ink emitting orifices, may be dynamically varied in the feed direction a distance which allows the ink jetted from one of the rows of orifices to substantially dry before ink is jetted from an adjacent row of orifices.

Other features and advantages of the invention may be realized from the drawings and detailed description of the invention that follows.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
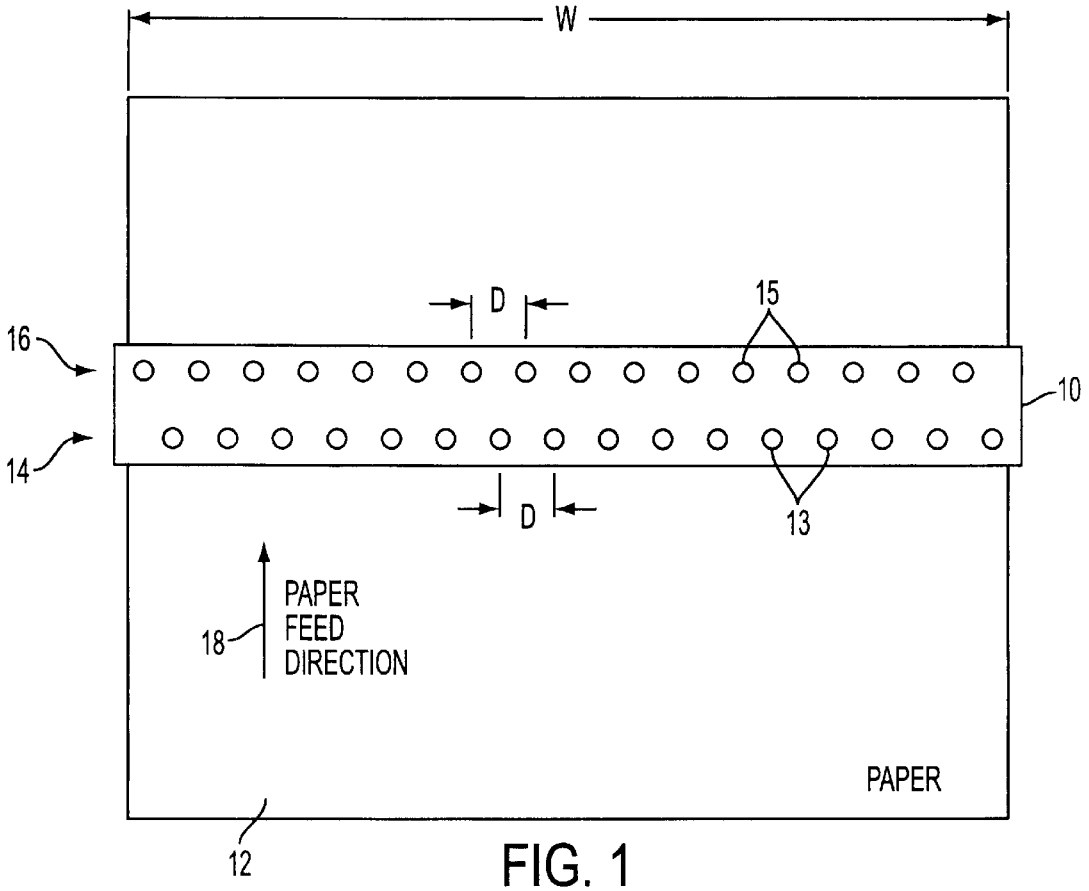
FIG. 1 is a schematic view of an embodiment of a page-width printhead of the present invention for use in an ink jet printer, with which the method of the present invention may be carried out.
Figure 2:
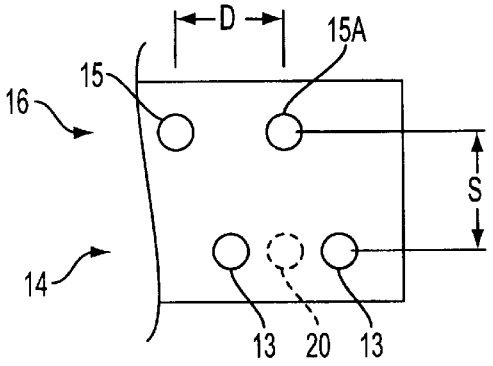
FIG. 2 is an enlarged, fragmentary view of a portion of the printhead shown in FIG. 1.

Referring now to the drawings and more particularly to FIGS. 1 and 2, there is shown an embodiment of a page width printhead 10 of the present invention for use in an ink jet printer for jetting an ink (not shown) onto a print medium such as paper 12. Printhead 10 may be used to carry out the method of printing of the present invention, as will be described hereinafter.

Printhead 10 includes at least two rows of ink emitting orifices 14 and 16 which extend substantially across a width "W" of paper 12. Row 14 includes a plurality of individual ink emitting orifices 13 and row 16 includes a plurality of individual ink emitting orifices 15. Each orifice 13 and 15 within rows 14 and 16, respectively, is spaced at a common distance "D" from an adjacent orifice within the same row of orifices 14 or 16. In the embodiment of printhead 10 shown in FIGS. I and 2, orifices 13 within row 14 are staggered a distance of approximately ½ the common distance "D" relative to orifices 15 within row 16 in a direction transverse to a feed direction 18 of paper 12.

The print medium such as paper 12 is moved in a feed direction 18 relative to the page wide printhead 10 extending thereacross. During printing, paper 12 is moved in feed direction 18 at a particular advance speed or velocity "v". The advance speed "v" typically remains constant during a particular print job; however, it is possible that the advance speed may also vary during a particular print job. As paper 12 is moved in feed direction 18 past printhead 10, ink is selectively jetted from orifices 13 of row 14 and orifices 15 of row 16. The ink which is jetted from orifices 13 and 15 has a known approximate drying time after being jetted onto paper 12 from printhead 10. Of course, many types of inks are available for possible use with printhead 10. However, in the embodiment shown, only one particular ink having known physical characteristics and a known approximate drying time is used with printhead 10. The specifically chosen ink may vary dependent upon the particular application for which printhead 10 is to be used.

Referring now more specifically to FIG. 2, each row of orifices 14 and 16 are spaced apart from each other in the feed direction 18 a distance "S" which is dependent upon an advance speed of print medium 12 and an approximate drying time of the ink jetted from printhead 10. Spacing "S" is established between rows 14 and 16 such that ink is jetted from orifices 15 of rows 16 after the ink which is jetted from orifices 13 of row 14 onto paper 12 has substantially dried. This provides an improved print quality and inhibits the formation of print artifacts on paper 12.

More particularly, the ink which is jetted from selected ones of the orifices 13 from row 14 is allowed to substantially dry before the ink is jetted from selected ones of the is orifices 15 from row 16. The particular ink which is jetted from printhead 10 is selected such that the drying time of the ink satisfies the mathematical relationship:

$$S/v \geqq t$$

where

S=spacing in the feed direction between the two rows of orifices 14 and 16 (in.);

v=advance speed of the paper in the feed direction (in./sec.); and t=drying time of the jetted ink (sec.);

which may be mathematically manipulated such that the spacing "S" is determined from the formula:

$$S \geqq t*v.$$

It is thus possible, using the known advance speed of paper 12 and the drying time of the ink, to manufacture printhead 10 with a spacing "S" between the rows of orifices 14 and 16 which provides an improved print quality and inhibits the formation of print artifacts in the print image on paper 12.

During printing on paper 12 using printhead 10, paper 12 is advanced in feed direction 18 at a known advance speed. Ink is jetted from selected orifices 13 within row 14 onto paper 12 as paper 12 is advanced in feed direction 18. Thereafter, ink is jetted from selected orifices 15 within row 16 onto paper 12 after the ink jetted from orifices 13 has substantially dried.

For comparison purposes, an orifice 15A within row 16 is shown in relation to two orifices 13 within row 14 in FIG. 2. Orifice 15A would conventionally be placed at location 20 between the two orifices 13. If the orifice 15A was placed at location 20 in a conventional manner, it would thus be necessary to jet ink from orifice 15A at location 20 for a desired pixel associated with paper 12 as paper 12 travels past row 14. As described above, however, this may result in a poor print quality and formation of a print artifact on paper 12. By moving orifice 15A in printhead 10 a distance corresponding to spacing "S" in the feed direction, as shown, a time delay is created between adjacent ink dots which results in an improved print quality.

Figure 3:
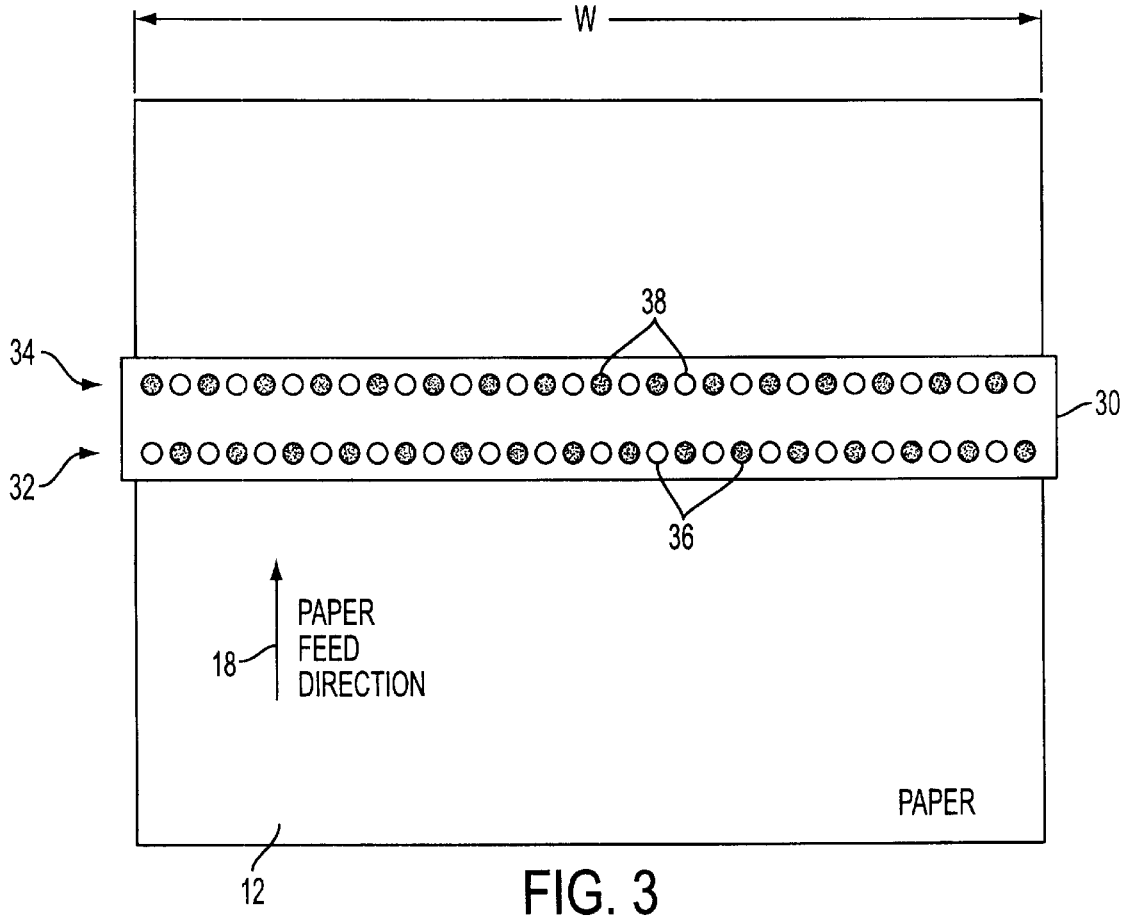
FIG. 3 is a schematic view of another embodiment of a page width printhead of the present invention for use in an ink jet printer, with which the method of the present invention may be carried out.

FIG. 3 is a schematic view of another embodiment of a page width printhead 30 of the present invention for use in an ink jet printer, with which the method of printing described above may be carried out. Printhead 30 includes two rows of orifices 32 and 34, with individual orifices being respectively referenced 36 and 38 in FIG. 3. Row 32 includes twice as many orifices as the row of orifices 14 of printhead 10 shown in FIGS. 1 and 2. Likewise, row 34 includes twice as many orifices 38 as the row of orifices 16 of printhead 10.

In contrast with the embodiment of printhead 10 shown in FIGS. 1 and 2, the row of orifices 34 of printhead 30 are substantially aligned relative to the row of orifices 32 in a direction transverse to feed direction 18 (that is, a line drawn parallel to feed direction 18 through the center of an orifice 36 in row 32 also extends through an approximate center of an orifice 38 in row 34). Within the row of orifices 32, only alternating orifices 36 are actually used during printing. For example, in the embodiment shown, the alternating orifices 36 used during printing have been filled-in or blackened. Likewise, within row of orifices 34, only alternating orifices 38 are used during printing, again represented by filledin or blackened orifices 38. It is apparent from FIG. 3 that ink which is jetted from the filled in orifices 38 in row of orifices 34 are offset or staggered relative to the filled in orifices 36 which are used in the row of orifices 32. Thus, it will be noted that the orifices 36 and 38 which are actually used within printhead 30 are disposed in a staggered relationship relative to each other similar to the embodiment of printhead 10 shown in FIGS. 1 and 2.

The non-used orifices 36 within the row of orifices 32 and the non-used orifices 38 within the row of orifices 34 function as redundant orifices in the embodiment shown allowing continued use of printhead 30 in the event a particular orifice 36 or 38 fails. Such a failure might be the result of a blockage of an orifice 36 or 38, or a failure of a heater element associated with a particular orifice 36 or 38. In the event of a failure of an orifice 36 or 38, an adjacent orifice in an adjacent row of orifices may be used to allow continued use of printhead 30.

Figure 4:
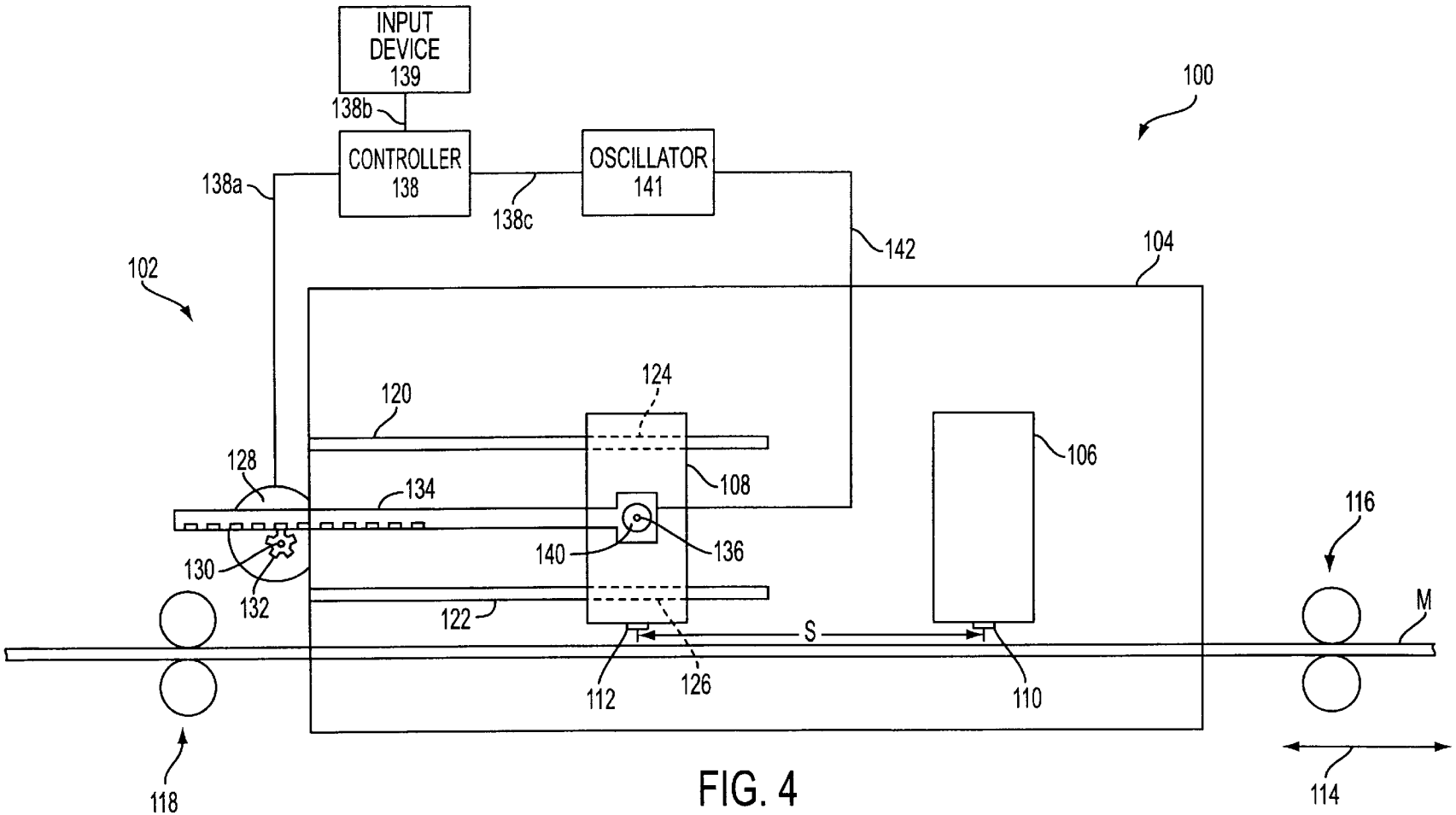
FIG. 4 is a schematic view of a system for varying a spacing between adjacent columns, or rows, of ink emitting orifices.

FIG. 4 is a schematic illustration of a printing system 100 having a printing mechanism 102 and a printer chassis 104. Printing mechanism 102 includes a first printhead 106 and a second printhead 108. Printheads 106 and 108 each include at least one ink emitting orifice, and preferably, include a row of ink emitting orifices 110 and 112, respectively. As shown, printhead 106 is fixedly mounted to chassis 104, and printhead 108 is movably mounted to chassis 104. Printheads 106, 108 are juxtapositioned at a location above print medium, or sheet, M such that orifices 110, 112 are adjacent sheet M. Sheet M is transported in the sheet feed direction 114 under printheads 106, 108, for example, by a pair of transport rollers 116 and a pair of exit rollers 118.

Chassis 104 includes a pair of printhead guide rods 120, 122, which slidably engage openings 124, 126, respectively, of printhead 108, such that printhead 108 can be moved in a direction parallel to the sheet M in sheet feed direction 114 so as to vary a spacing "S" between orifice row 112 and orifice row 110. Movement of printhead 108 is effected by actuating an electromechanical device, such as a motor 128, which can be for example, a stepper motor or other DC motor. Motor 128 includes a rotatable shaft 130 having a pinion gear 132 mounted thereto. The teeth of gear 132 engage the teeth of a rack gear 134. Together, gears 132 and 134 form a mechanical actuator. One end of rack 134 is attached to printhead 108 by a fastening device 136, such as a pin, screw, bolt, etc. Thus, by controlling the rotation of motor shaft 130, the spacing "S" between orifice rows 110 and 112 can be varied and controlled. The actuation and control of motor 128 is achieved by a motor controller 138 which supplies electrical signals to motor 128 via a motor control line 138*a*.

Preferably, the spacing "S" between printhead orifice rows 110 and 112 is defined by the mathematical relationship $S \geqq V \times T_D$, wherein: S is the distance between orifice rows 110 and 112;

V is the velocity of the print medium; and $T_D$ is the ink drying time.

Thus, controller 138 positions printhead 108 to satisfy the equation above, so as to compensate for one or more of 1) changes in the print media velocity "V", and 2) changes in the drying time $T_D$ of the ink, such changes occurring, for example, due to the drying characteristics of various types of inks, or the enviromnental changes which affect ink drying time of a particular ink. To accomplish this spacing control, an input signal representing velocity "V" of the print medium and/or ink drying time $T_D$ is received by controller 138 from input device 139 via input line 138*b*. Input device 139 can be, for example, a memory unit containing stored information relating to print medium velocity, ink drying time, or other data relating to a desired spacing between the orifices of orifice rows 110 and 112, which is accessed by a microprocessor of controller 138. Such information can be, for example, in the form of a look-up table. Alternatively, input unit 139 may supply signals representing real-time measured and/or calculated values for velocity "V" of the print medium and/or ink drying time $T_D$.

As a secondary means for controlling the spacing "S", and so as to provide for fine dynamic control of the position of printhead 108, preferably, a piezoelectric material 140 is positioned at some location in the drive train between the teeth of gear 130 and printhead 108. The location of the piezoelectric material can be, for example, at, or form all or part of, fastener 136. Those skilled in the art will recognize that the piezoelectric material 140 can be positioned between any two adjacent components of the drive train comprised by elements 128, 130, 132, 134, 136 and the associated printhead to achieve the desired results.

The piezoelectric material 140 is energized by a variable frequency oscillator 141 via line 142, wherein the actuation of oscillator 141 is controlled by controller 138 via an oscillator control line 138*c*. Upon energization of piezoelectric material 140, the mechanical structure of piezoelectric material 140 is modified so as to compensate for dynamic perturbations in the print medium velocity "V" which occurs at frequencies beyond the reaction capabilities of motor 128 and gear train 132, 134.

It is to be understood that in practicing the invention, the spacing of at least two printing elements can be achieved by operating the system in a static mode, wherein the spacing change is effected prior to beginning printing, and/or a dynamic mode, wherein the spacing change(s) is/arc effected after printing has commenced.

Although the embodiment of FIG. 4 is directed to moving one of a plurality of printheads, those skilled in the art will realize that the invention can be easily adapted to variably control the position of any or all of the plurality of printheads. Furthermore, in view of the invention, one skilled in the art will recognize that the motor/gear train system may be replaced with other types of electrical, mechanical or electro-mechanical systems for effecting a change in spacing between the printheads, such as for example, by replacing the motor with another type of electromechanical device, e.g., an electrical solenoid, and by replacing the gear train with another form of mechanical actuator, e.g., a linkage.

In the embodiments of the present invention shown in the drawings, the print medium is in the form of paper 12. However, it is also to be understood that other types of print media, such as transparencies, card stock, etc., may be utilized with the method of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printing system comprising a spacing device which varies a physical spacing between at least a first printing element and a second printing element and a controller for controlling said spacing device, said spacing device including a drive train having:

an electromechanical device defining one end of said drive train;

a carrier transporting one of said first printing element and said second printing element and defining another end of said drive train; and a piezoelectric material mechanically coupled in series between said electro-mechanical device and said carrier in said drive train.

2. The system of claim 1, further comprising a printer controller electrically coupled to said spacing device.

3. A printing system comprising:

a spacing device which varies a physical spacing between at least a first printing element and a second printing element, said spacing device including:

an electr-omechanical device;

a carrier transporting one of said first printing element and said second printing element, said electro-mechanical device and said carrier defining the ends of a drive train; and a piezoelectric material mechanically coupled within said drive train; and a printer controller electrically coupled to said spacing device, said printer controller operating to control said spacing device to vary said physical spacing between said first printing element and said second printing element based upon at least one of an advance speed of a print medium and an approximate drying time of an ink after being deposited on said print medium.

4. A printing system comprising:

a spacing device which varies a physical spacing between at least a first printing element and a second printing element said spacing device including:

an electromechanical device;

a carrier transporting one of said first printing element and said second printing element said electro-mechanical device and said carrier defining the ends of a drive train;

a mechanical actuator coupled between said electro-mechanical device and said carrier; and a piezoelectric material mechanically coupled within said drive train; and a printer controller electrically coupled to said electromechanical device.

5. The system of claim 4, wherin said piezoelectric material is electrically coupled to said printer controller.

6. The system of claim 4, wherein said mechanical actuator comprises at least one of a gear train and a linkage.

7. A printing system comprising:

a spacing device which varies a physical spacing between at least a first printing element and a second printing element, said first printing element being associated with a first printhead and said second printing element being associated with a second printhead, said spacing device including:

an electro-mechanical device;

a carrier transporting one of said first printing element and said second printing element, said electro-mechanical device and said carrier defining the ends of a drive train; and a piezoelectric material mechanically coupled within said drive train;

a controller; and means for supplying to said controller a signal representing at least one of an advance speed of a print medium in a feed direction in the printing system and an approximate drying time of the ink after being deposited onto the print medium by at least one of said first printing element and said second printing element;

said spacing device being responsive to said controller for varying the spacing between said first printing element and said second printing element on the basis of said at least one of the advance speed of the print medium and the approximate drying time of the ink.

8. A printing system comprising a spacing device which varies a physical spacing between at least a first printing element, and a second printing element, and a controller for controlling said spacing device, said spacing device including:

an electromechanical device for effecting a relative movement of said first printing element with respect to a location of said second printing element;

a carrier transporting one of said first printing element and said second printing element, said electromechanical device and said carrier defining the ends of a drive train; and a piezoelectric material mechanically coupled within said drive train.

9. A printing system comprising:

a spacing device which varies a physical spacing between at least a first printing element and a second printing element, said first printing element being associated with a first printhead and said second printing element being associated with a second printhead, said spacing device including:

an electro-mechanical device;

a carrier transporting one of said first printing element and said second printing element, said electro-mechanical device and said carrier defining the ends of a drive train; and a piezoelectric material mechanically coupled within said drive train;

a printer controller electrically connected to said electromechanical device; and a mechanical actuator coupled to said electromechanical device and to one of said first printhead and said second printhead;

wherein when said electromechanical device is energized by said printer controller, a change in spacing between said first printhead and said second printhead is effected.

10. A printing system comprising a spacing device which varies a physical spacing between at least a first printing element and a second printing element, and a controller for controlling said spacing device, said first printing element being associated with a first printhead, said spacing device including:

an electro-mechanical device;

a carrier transporting one of said first printing element and said second printing element, said electro-mechanical device and said carrier defining the ends of a drive train;

a piezoelectric material mechanically coupled within said drive train; and a drive mechanism coupled to said first printhead and to said electro-mechanical device, wherein when said electro-mechanical device is activated, a change in spacing between said first printing element and said second print element is effected.

11. An apparatus for controlling a spacing between a plurality of print nozzles which jet ink in an ink jet printing system having a controller, comprising:

means for supplying to said controller a signal representing an advance speed of a print medium in a feed direction in the printing system and an approximate drying time of the ink after being jetted onto the print medium by at least one of said plurality of print nozzles; and means, responsive to said controller, for varying the spacing between at least two of said plurality of nozzles on the basis of the advance speed of the print medium and the approximate drying time of the ink.

12. The apparatus of claim 11, wherein a first nozzle of said plurality of nozzles is associated with a first printhead and a second nozzle of said plurality of nozzles is associated with a second printhead, said means for varying the spacing comprising:

a mechanical actuator coupled to one of said first printhead and said second printhead; and an electro-mechanical device coupled to said mechanical actuator, wherein when said electro-mechanical device is actuated by said controller, said mechanical actuator effects a change in spacing between said first printhead and said second printhead.

13. The apparatus of claim 12, wherein said mechanical actuator comprises at least one of a gear train and a linkage.

14. The apparatus of claim 12, further comprising a piezoelectric material positioned between at least one of:

said mechanical actuator and said first printhead;

said mechanical actuator and said electro-mechanical device; and at least two components comprising said mechanical actuator.

15. The apparatus of claim 11, wherein a first nozzle of said plurality of nozzles is associated with a first printhead and a second nozzle of said plurality of nozzles is associated with a second printhead, said means for varying the spacing comprising:

a member;

a piezoelectric material mechanically coupled between at least one of said first printhead and said member; and an oscillator electrically coupled to said piezoelectric material which supplies an electrical signal to said piezoelectric material.

16. A method of controlling a spacing between multiple print elements in a printing system, comprising the steps of:

determining an advance speed of a print medium in a feed direction in the printing system; and varying a spacing between at least two of said multiple print elements on the basis of said advance speed.

17. The method of claim 16, further comprising the steps of:

determining an approximate drying time of an ink after being jetted onto the print medium by at least one of said multiple print elements; and varying a spacing between at least two of said multiple print elements on the basis of at least one of said advance speed and said drying time.

18. A method of controlling a spacing between multiple print elements in a printing system, comprising the steps of:

determining an approximate drying time of an ink jetted onto a print medium; and varying a spacing in a transport direction of a print medium between at least two of said multiple print elements on the basis of said drying time.

19. The method of claim 18, further comprising the steps of:

determining an advance speed of said print medium in a feed direction in the printing system; and after printing has commenced, varying a spacing in the transport direction of the print medium between at least two of said multiple print elements on the basis of said advance speed and said drying time.

20. A printing system comprising:

a spacing device which varies a physical spacing between at least a first printing element and a second printing element in a direction corresponding to a transport direction of a print medium, said first printing element being associated with a printhead having at least one opening, said at least one opening having a longitudinal direction substantially parallel to the transport direction of the print medium; and a fixed structure including at least one guide rod slidably engaging said at least one opening of said printhead to thereby enable sliding movement of said printhead in either of two opposite directions substantially parallel to the transport direction of the print medium, said fixed structure being attached to said second printing element.

21. The system of claim 20, further comprising a printer controller electrically coupled to said spacing device.

22. The system of claim 21, wherin said printer controller operates to control said spacing device to vary physical spacing between said first printing element and said second printing element based upon at least one of an advance speed of a print medium and an approximate drying time of an ink being deposited on said print medium.

23. The system of claim 21, wherin said spacing device comprises:

an electro-mechanical device electrically coupled to said printer controller; and a mechanical actuator coupled between said electro-mechanical device and a carrier transporting one of said first printing element and said second printing element.

24. The system of claim 23, wherin said electro-mechanical device and said carrier define the ends of a drive train, and further comprising a piezoelectric material electrically coupled to said printer controller and mechanically coupled between at least two adjacent components in said drive train.

25. A printing system comprising a spacing device which varies a physical spacing between at least a first page width printhead and a second page width printhead in a direction corresponding to a transport direction of a print medium, said spacing device including a drive train coupled to one of said first page width printhead and said second page width printhead.

* * * * *